US005417489A

United States Patent [19]

Compagnucci

[11] Patent Number: 5,417,489

[45] Date of Patent: May 23, 1995

[54] RUNNER WITH TELESCOPIC RODS CONSISTING OF EXTRUDED ALUMINUM TUBULAR SECTIONS, FOR FURNITURE PULL-OUTS

[75] Inventor: Rossano Compagnucci, Osimo, Italy

[73] Assignee: Compagnucci- S.p.A., Italy

[21] Appl. No.: 239,360

[22] Filed: May 6, 1994

[30] Foreign Application Priority Data

May 14, 1993 [IT] Italy ..... MC93A0033

[51] Int. Cl.[6] ..... A47B 88/10

[52] U.S. Cl. ..... 312/334.11; 384/18; 312/334.17; 312/334.44

[58] Field of Search ..... 312/334.11, 334.15, 312/334.17, 334.25, 334.26, 334.33, 334.38, 334.44, 334.45, 334.9, 334.37; 384/18, 19

[56] References Cited

U.S. PATENT DOCUMENTS 4,469,384 9/1984 Fler et al. ..... 312/334.11 X
4,610,487 9/1986 Delmege et al. ..... 384/18
4,653,821 3/1987 Faust ..... 312/334.48
5,020,869 6/1991 Faust ..... 384/18 X
5,181,781 1/1993 Wojcik ..... 312/334.44 X
5,242,221 9/1993 Rutthowe ..... 384/18 X

FOREIGN PATENT DOCUMENTS 1125346 6/1982 Canada ..... 312/334.11
471130 10/1914 France ..... 312/334.11

*Primary Examiner*—Jose V. Chen
*Assistant Examiner*—Rodney White
*Attorney, Agent, or Firm*—Leonard Bloom

[57] ABSTRACT

A drawer runner having telescopic rods sliding on balls, and consisting of extruded aluminum tubular sections.

The rods are characterized by a rhomboidal tubular section having arched sides, sliding in another tubular section having a square cross-section and rounded edges, so as to form four identical sliding tracks for the balls, staggered at 90°, and delimited externally by the rounded corners of the external section and internally by the arched sides of the internal section.

6 Claims, 2 Drawing Sheets

4a
5
3f
4b
3a
7
7
3
8
7
7
3d
2a
3e
3e
2
8
2e
2e
2d
1

6
4a
5
4
4c
V
3f
4b
3a
3
3e
2
2c
2b
9a
2a
7
8b
7
2e
7
1c
1b
7
1a
1A
8
1
8a

RUNNER WITH TELESCOPIC RODS CONSISTING OF EXTRUDED ALUMINUM TUBULAR SECTIONS, FOR FURNITURE PULL-OUTS

This design patent application concerns a drawer runner having telescopic rods sliding on balls, and consisting of extruded aluminium tubular sections.

Current standard runners for drawers, or more generally, for furniture pullouts sliding on wheels, consist of two pressed sheet plate sections—a box shaped section that is fixed inside the side panels of the drawer while the other section is housed and slides within the first, and is fixed externally to the longitudinal sides of the drawer.

Telescopic type runners are also available on the market, but the only difference with respect to standard runners, is that they have a third box-shaped section fitted between the first box-shaped section screwed to the side panels of the drawer and the second section, screwed on the exterior of the longitudinal sides of the drawer.

In all cases said box-shaped sections are characterized by a transverse "C" cross-section.

Recently groups of balls have been used instead of the traditional nylon wheels, in an attempt to improve sliding. In these models the steel balls are housed and slide in pairs of overlying semi-cylindrical tracks on the interfaced longitudinal edges of the sections.

One of the main problems common to all said runner models for drawers sliding on wheels or balls is that they have a low resistance to supporting and opposing transverse, horizontal or sub-horizontal strain; in other words, although said wheels or balls ensure adequate support and runner action for the weight of the drawer, they do not adequately support lateral pressure on the right or left of the drawer which can easily occur When opening and closing the drawer.

The purpose of this invention is to develop a new runner model with telescopic rods for furniture pullouts that guarantees constant supporting and runner capacity regardless of the direction of the load pressure applied to the pullout.

This has been possible thanks to a special profiling of the transverse section of the telescopic rods being the elements which make up the runners according to the invention.

More specifically, the traditional "C" shaped cross-section has been replaced by an external section having square cross-section slotted at the bottom and rounded edges and an internal section having four equal angles and arched sides thereby forming four identical sliding tracks, staggered by 90° and delimited externally by the rounded edges of the external tubular section and internally by the arched sides of the internal tubular section.

In said sliding tracks being fixed groups of balls which are caged at constant center to center distances within a collar with bottom slots and having four longitudinal rows of holes, staggered by 90°, each housing a ball.

For major clarity the description of the invention continues with reference to the drawings which are intended for purposes of illustration and not in a limiting sense whereby:

Figures 1, 2, 3:
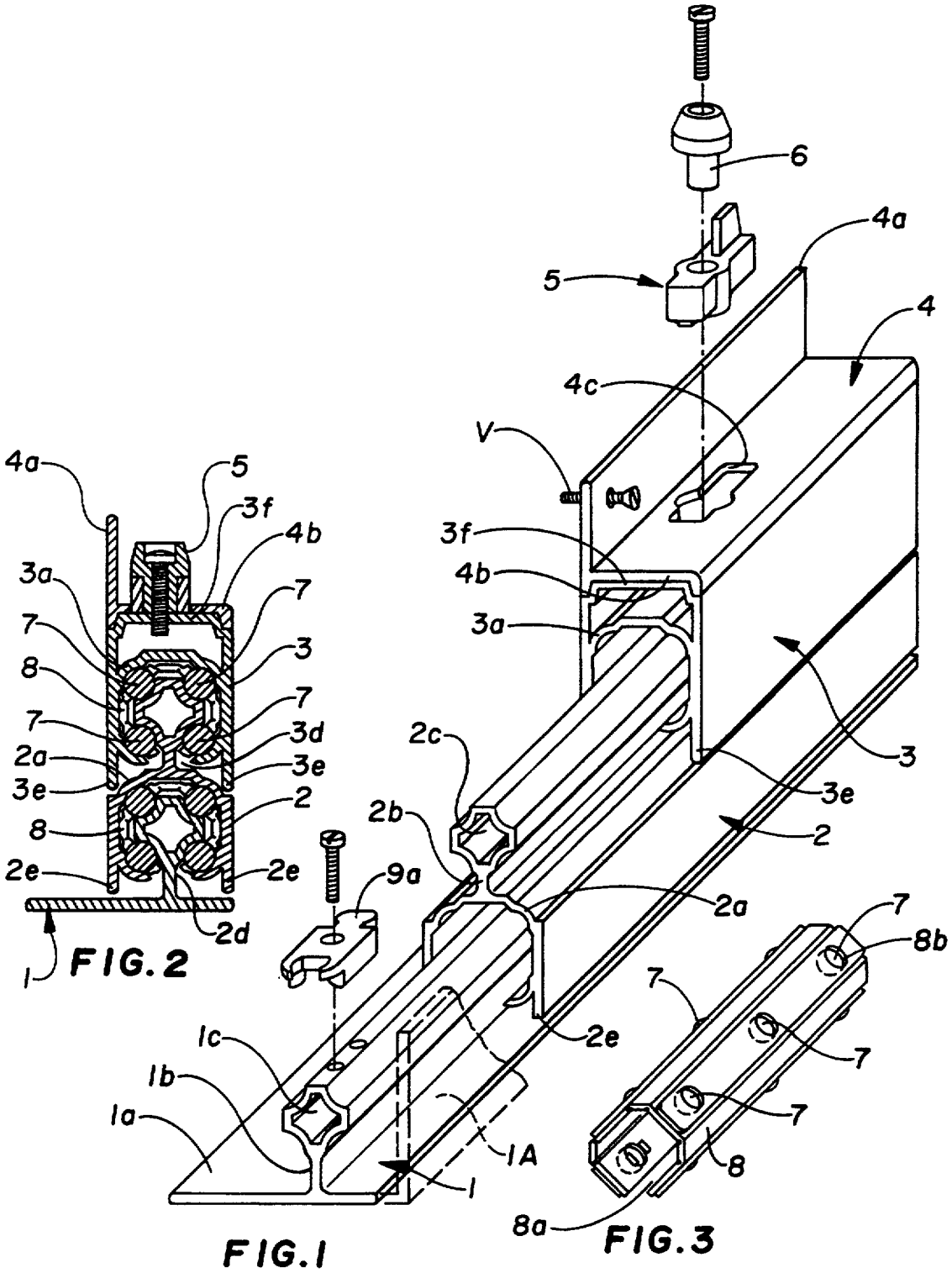
FIG. 1 is an axonometric view of a runner section according to the invention with its rods partially drawn out.
FIG. 2 is a cross-section on transverse plane of the runner according to the invention.
Figure 4:
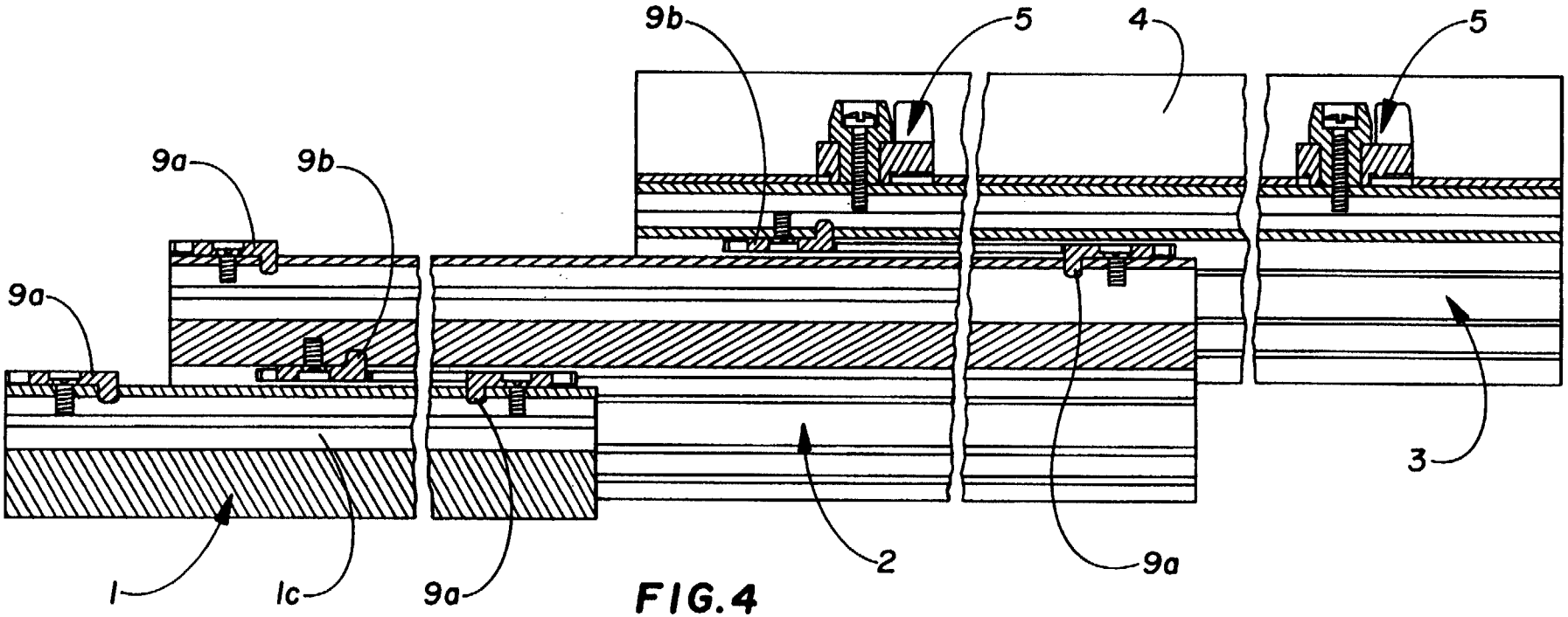

FIG. 3 an axonometric view of the slotted support collar for the balls which improve sliding between the sections;

FIG. 4 is a cross-section on a longitudinal plane of the runner according to the invention, with the rods partially drawn out.

With reference to 1–4, the runner according to the invention consists of three sections (1, 2 and 3), fitted and sliding in one another, and pressed in extruded aluminium.

Section (1), which is fixed to the drawer, features a flat flange (1*a*), connected by a rib (1*b*) to a tubular element (1*c*) characterized by a rhomboidal cross-section, with four identical internal angles and four arched sides.

Profile (2) consists of a tubular element (2*c*) identical to (1*c*) to that of section (1); said tubular element (2*c*) is connected at the bottom by means of a rib (2*b*), to another tubular element (2*a*), having a square cross-section, with rounded angles and a centre slot (2*d*) on its base, which is intersected by the rib (1*b*) of section (1).

The lateral walls of the tubular element (2*a*) extend towards the bottom with two vertical flanges (2*e*), whose bottom edge touches the base flange (1*a*) of section (1).

Section (3), which is fixed to the furniture pullout, features a tubular element (3*a*) identical to that (2*a*) of section (2); section (3) is characterized by a square cross-section with rounded angles, cut at the base by a centre slot (3*d*) and having bottom flanges (3*e*) on the sides, whose bottom edge touches and aligns with the lateral walls of element (2).

The lateral walls of tubular element (3*a*) extend upwards to couple with a horizontal flange (3*f*) enclosing and concealing below the upper wall of tubular element (3*a*).

Profile (3) is fixed to the furniture pullout by means of a fourth section (4) consisting of an "L" square whose vertical flange (4*a*) is fixed by screws (V) or similar, to the furniture pullouts, while its horizontal flange (4*b*) is fixed, by means of a fast hooking and release device, to flange (3*f*) of section (3).

Device includes a pair of almost rectangular stop knobs (5), which idle around a center pin (6) screwed above flange (3*f*) of section (3).

The horizontal flange (4*b*) of the "L" square (4) having a slot (4*c*) with the same plan as the knobs (5), at both its ends.

Once square (4) is fixed to the furniture pull-out, in order to fix the pullout to the telescopic runner, the same need simply be fitted over the runner so that the two knobs (5) fit into the corresponding and conforming slots (4*c*) of square (4); at this point it will be sufficient to rotate the knobs (5) slightly to fix the horizontal flange (4*f*) of square (4) under the knobs thereby stopping, fastening and hooking square (4) above flange (3*f*) of section (3).

It should be noted that vertical flange (4*a*) of square (4) aligns perfectly with the lateral wall of the underlying section (3).

With particular reference to FIG. 3, attention is drawn to the groups of balls fitted between the sections (1, 2 and 3) to improve their reciprocal sliding.

Balls (7) are caged in a collar (8), having a slot at the bottom (8*a*) and four regularly spaced rows of holes (8*b*) staggered at 90° in which balls (7) are housed. Balls (7) are pre-assembled in said collar (8), which is then fitted between the tubular element with square cross-section (2*a* and 3*a*) and the tubular elements having rhomboidal cross-section (1*c* and 2*c*), so that the four rows of balls (7) fit respectively into the longitudinal sliding tracks, delimited internally by the arched sides of the tubular elements having rhomboidal cross-section (1*c* and 2*c*), and externally by the rounded edges of the tubular elements having square cross-section (2*a* and 3*a*).

Slot (8*a*) of collar (8) being intersected by ribs (1*b* and 2*b*) of sections (1 and 2).

FIG. 4 shows two plastic plates (9*a* and 9*b*) which act as endplates for the end of the sliding run of one section with respect to another.

The plates (9*a* and 9*b*) each terminate at one end with an ovoidal head and at the other end with a fork having an internally concave profile conforming to the external convex profile of the above head so that the head of one plate enters and is hooked to the fork of another plate.

As shown in FIG. 4, plate (9*a*) is screwed externally above and at the end of the tubular elements (1*c* and 2*c*), while plate (9*b*) is screwed internally and at the end of tubular elements (2*a* and 3*a*).

It should be rioted that section (1) could be fitted with a second flange (1A) perpendicular to that (1*a*) of the above flange, when section (1) is screwed on the side of the furniture unit housing the pullout.

The horizontal flange (1*a*) in fact can be utilized as a support and anchoring flange of the telescopic runner to the furniture unit only when fixed to the bottom of the unit, while the vertical flange (1A) acts as support when the runner stops on the internal wall of the side panels of the furniture unit.

I claim:

1. A runner having telescopic rods for furniture pullouts, comprising tubular sections of extruded aluminium whereby the:

a first section (1) having a flat flange (1*a*), connected by a first rib (1*b*) to a first tubular element (1*c*), having a rhomboidal cross-section, with four identical internal angles and four arched sides;

a second section (2) having a tubular element (2*c*) identical to that (1*c*) of said first section (1), which is connected at its bottom, by means of a second rib (2*b*) to a third tubular element (2*a*), having a square cross-section, with rounded angles and a center slot (2*d*) on its base, intersected by said first rib (1*b*) of said first section (1);

a third section (3) having a fourth tubular element (3*a*), identical to said third tubular element (2*a*) of section (2) characterized by side walls which extend upwards to couple with a horizontal flange (3*f*) above which and upper wall of said fourth tubular element (3*a*) is enclosed and concealed;

a number of collars (8), each having a longitudinal slot (8*a*) at its bottom and having four rows of regularly spaced holes (8*b*) staggered at 90°, housing balls (7), which fit into four longitudinal sliding tracks, delimited internally by the said arched sides of the first and second tubular elements with rhomboidal cross-section (1*c* and 2*c*) and externally by rounded edges of the said third and fourth tubular elements with square cross-section (2*a* and 3*a*).

2. A runner having telescopic rods for furniture pullouts, comprising tubular sections of extruded aluminium, according to claim 1), whereby said third section (3) is fixed to a fourth section (4) having an "L" shaped square with a first vertical flange (4*a*) and screws for fixing the flange (4*a*) to the pullout, while a second horizontal flange (4*b*) is fixed by means of fast hooking and release device, to said first horizontal flange (3*f*) of said third section (3).

3. A runner having telescopic rods for furniture pullouts, comprising tubular elements of extruded aluminium according to the previous claim whereby the said fast hooking and release device, according to claim 2, includes a pair of almost rectangular stop knobs (5), idling around a respective center pin (6), screwed above said horizontal flange (3*f*) of said third section (3); the said second horizontal flange (4*b*) of the "L" square (4) having a slot (4*c*) with the same plan as the knobs (5), at both its ends.

4. A runner having telescopic rods for furniture pullouts, comprising tubular sections of extruded aluminium according to claim 1, whereby lateral walls of the tubular element (2*a*) extend downwards by means of first pair of vertical flanges (2*e*), having bottom edges that touch the base (1*a*) of section (1) and lateral walls of tubular element (3*a*) extend downwards by means of a second pair of vertical flanges (3*e*), having bottom edges that touch and align with the said lateral walls of said second section (2).

5. A runner having telescopic rods for furniture pullouts, comprising tubular elements of extruded aluminium according to claim 1, further comprising two end plates (9*a*, 9*b*) of a sliding run for one section with respect to another, each terminating at one end with an ovoidal head and at its opposite end other with a fork having an internally concave profile conforming to an externally convex profile of the said head, so that the said head of the plate enters and fixes to a second fork of another plate; plate (9*a*) being screwed externally above and at the end of the said first and second tubular elements (1*c* and 2*c*), while plate (8*b*) is screwed internally and at the end of the tubular elements (2*a* and 3*a*).

6. A runner having telescopic rods for furniture pullouts, comprising tubular sections of extruded aluminium according to claim 1, whereby the said first section (1) features a vertical flange (1A) perpendicular to said flat horizontal flange (1*a*).

* * * * *